United States Patent [19]

Becher

[11] Patent Number: 4,805,529

[45] Date of Patent: Feb. 21, 1989

[54] SELF-INKING RUBBER STAMPS

[76] Inventor: David Becher, 8 Dresner Street, Tel Aviv, Israel

[21] Appl. No.: 59,944

[22] Filed: Jun. 9, 1987

[30] Foreign Application Priority Data

Jun. 19, 1986 [IL] Israel ..... 79158

[51] Int. Cl.[4] ..... B41K 1/40

[52] U.S. Cl. ..... 101/334; 101/333; B41K/1/40

[58] Field of Search ..... 101/333, 334

[56] References Cited

U.S. PATENT DOCUMENTS

| | | | |
|---|---|---|---|
| 10,740 | 6/1886 | Hill | 101/334 |
| 1,142,240 | 6/1915 | Dodson | 101/334 |
| 2,312,727 | 3/1943 | Nisenson | 101/334 |
| 4,432,281 | 2/1984 | Wall et al. | 101/334 |
| 4,530,281 | 7/1985 | Verdenne | 101/334 |

FOREIGN PATENT DOCUMENTS

| | | | |
|---|---|---|---|
| 232014 | 7/1963 | Austria | 101/334 |

*Primary Examiner*—Paul T. Sewell
*Assistant Examiner*—James Lisehora
*Attorney, Agent, or Firm*—Ostrolenik, Faber, Gerb & Soffen

[57] ABSTRACT

A self-inking, automatic rubber stamping device, comprising a rubber stamp support plate moveable between a face-down, stamping position and a retracted position where it faces an ink pad. The ink pad is mounted in a vertical position, and the movement of the plate is governed by a combination of guide-slots so that during non-use of the device, the rubber stamp is not pressed against the ink pad, but kept apart therefrom. During every stamping cycle, the plate first approaches the pad to become wetted with ink, and then retracts and becomes overturned into the face-down stamping position.

6 Claims, 4 Drawing Sheets

SELF-INKING RUBBER STAMPS

BACKGROUND OF THE INVENTION

The present invention relates to self-inking rubber stamping devices.

Conventional self-inking or automatic stamps generally comprise a two-part housing, a solid-rubber printing stamp glued to a pivoted, displaceable base plate, and an ink-absorbent pad made of cellular rubber or felt. With light vertical pressure on the upper part of the housing, while the lower part is placed on a paper sheet, a stamping process is performed whereby the stamp, which contacts the ink pad, slides downwards, turns over into an upside-down position, and becomes pressed against the paper.

These devices suffer from numerous disadvantages. Due to the fact that the ink pad is installed face down at an elevated location within the housing, the overall height of the device is necessarily great, in order to leave enough room for the rubber stamp plate to perform a complete 180 degree overturn .

Secondly, the construction was such that the rubber stamp was in constant compressive contact with the ink pad. This continuous pressure on the ink pad caused excessive deformation of the pad which, of course, reduced its efficiency to ink the rubber molded characters of the stamp. If, on the other hand, a more rigid sponge were used as an ink pad, in order to better withstand the prolonged pressure, a print of poor quality would result.

Finally, the construction of the overturning mechanism and of the device as a whole necessitated the incorporation of a great number of parts and components, making the device more costly and less durable.

It is, therefore, the object of the invention to devise a self-inking stamping device that will effectively overcome the above-listed disadvantages.

It is a further object of the invention to reduce the height of the device and to obtain thereby a handy and conveniently operable device.

It is a still further object of the invention to have the ink pad installed in the device in an upright position, namely perpendicular to the printed surface.

It is a still further object of the invention to allow only a short wetting contact between the rubber stamp and the ink pad for every printing cycle, thereby avoiding the continuous compressive contact and the resulting damage to the ink pad.

It is a still further object of the invention to reduce a minimum the number of parts and components which compose the device.

SUMMARY OF THE INVENTION

According to the invention, there is provided a self-inking rubber stamping device comprising a housing having opposite side walls and an open bottom adapted to be placed over a surface to be stamped, and an ink pad fixedly mounted within the housing. A manipulable member having a top wall and opposite side walls is provided, which is coupled to and moveable with respect to the housing and includes a pivotable, as well as displaceable, rubber stamp plate.

The pivotal displacement of the stamp plate by the manipulable member is effected by an overturning mechanism, between an inoperative position, wherein the plate is withdrawn into the housing and the rubber stamp faces the ink pad, and an operative position, wherein the stamp plate is pivoted and displaced to become pressed against the said surface through the bottom of the housing. The ink pad is positioned at right-angles to and above the bottom of the housing. The stamp plate is moveable parallel to the ink pad, as well as rotatable about a first axis fixed relative to the housing, and is coupled to the manipulable member by an axle defining a second axis spaced from, and extending parallel to, the first axis. The axle is moveable along a curved path defined by the composite movement of first guide-slots formed in the opposite side walls of the housing and second guide-slots formed in the opposite side walls of the manipulable member through which the axle is passed, to bring the rubber stamp face-down against the said surface.

The plate may be provided with a pair of rearward extending U-shaped bars, and the side walls of the housing are each provided with a projection in axial alignment with one another along the said first axis, each projection supporting one of the bars during the parallel and the rotatable movement of the plate.

The guide-slots of either the manipulable member or the housing member are configured so that in the inoperative position, the rubber stamp is spaced from the ink pad, and the movement of the plate is commenced by the plate approaching the pad, which movement effects the wetting of the rubber stamp by the pad.

The manipulable member may be either hinged or slidingly mounted on the housing member.

Further details of construction and advantages of the invention will become more clearly understood in light of the ensuing description of two preferred embodiments of the invention, given by way of example only, with reference to the accompanying drawings, wherein

DETAILED DESCRIPTION OF THE PREFERRED EMBODIMENTS

Figure 1:
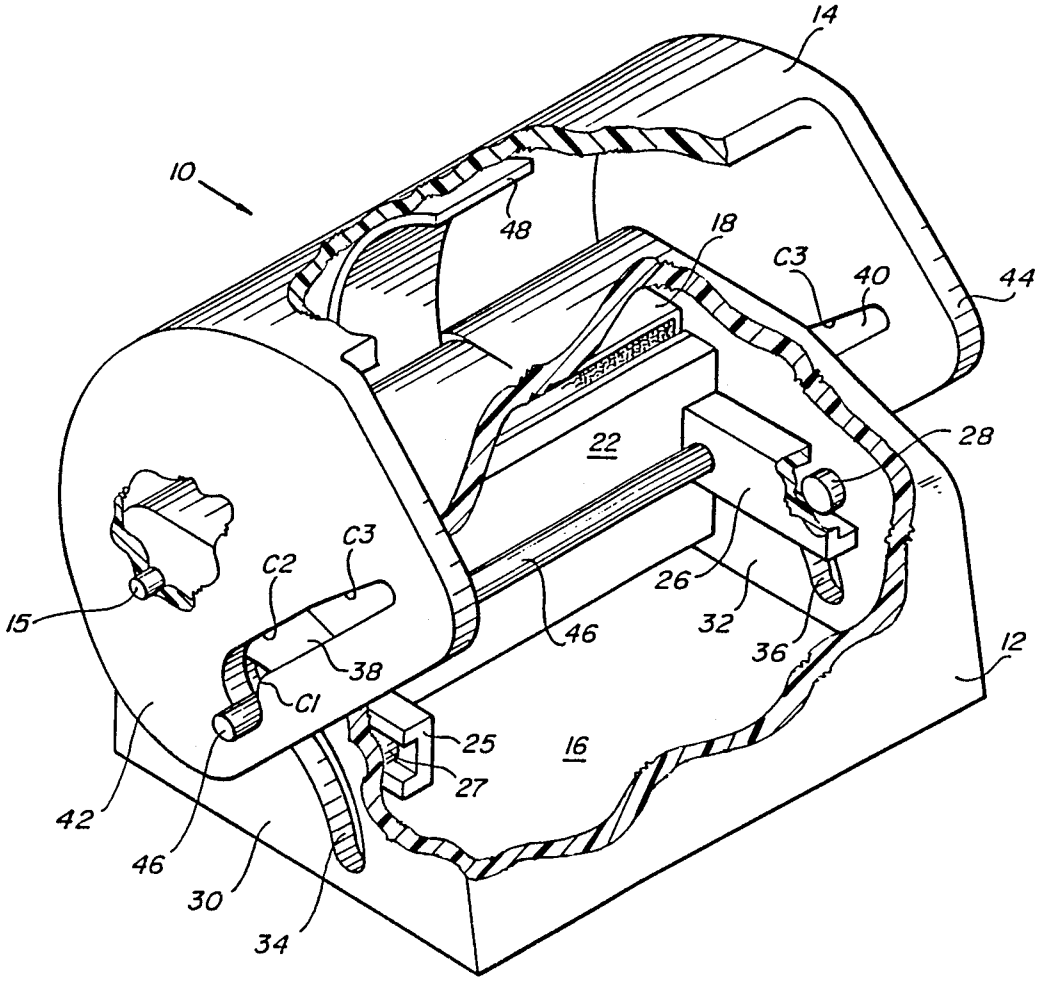
FIG. 1 is a general, three-dimensional view of the device according to a first embodiment of the invention.

The stamping device generally denoted 10 in FIG. 1 comprises a stationary housing member 12 and a manipulable member 14, hinged to the housing member 12 by pins 15 (only one being shown in FIG. 1). The housing 12 has an open bottom 16.

Figure 2A:
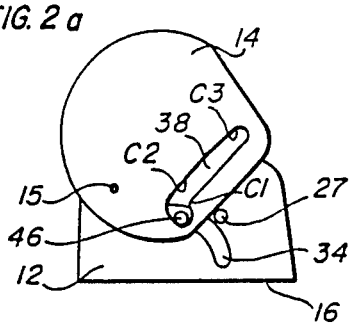
FIG. 2*a* is a side view of the device of FIG. 1 in its inoperative position.
Figure 2B:
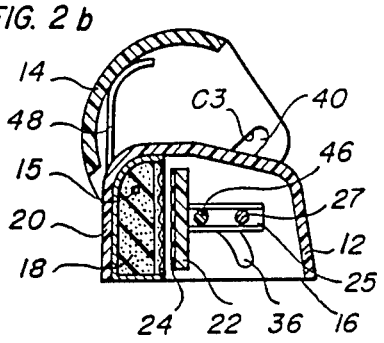
FIG. 2*b* is a sectional view of the device of FIG. 2*a;*

Ink pad 18 is accommodated within the housing 12 against a rear wall 20 (FIG. 2*b*), means being provided (not shown) for the removal of the pad in case it needs replacement. Further, within the housing 12, is accommodated a rubber stamp plate 22 with rubber stamp 24 attached thereto. The plate 22 and the ink pad 18 face each other, both being vertically positioned—in contradistinction to conventional devices where the pad and the stamp were horizontally positioned, the pad facing down and the stamp facing up thereagainst. The plate 22 is extended rearward by a pair of U-shaped bars 25, 26, both facing outward to serve as guide-slots operatively associated with a pair of inward directed pins 27 and 28, respectively.

The pin 27 is formed integrally with side wall 30 of the housing 12, and the pin 28 is formed integrally with side wall 32. Alternatively, the pins 27 and 28 may be attached separately to the housing walls 30 and 32, respectively; or, the guide-slots, constituted by the bars 25, 26, may be associated with walls 30, 32 and pins 27, 28 formed as part of the stamp plate 22—all at the designer's option. The side walls 30 and 32 of the housing 12 are each provided with an arcuate, downward-sloping guide-slot, designated 34 and 36, respectively.

Generally upward-sloping guide-slots 38 and 40 are formed in side walls 42 and 44 of the manipulable member 14. In the described embodiment, the slots 38 and 40 comprise a convex cam surface or portion C1, a substantially straight cam portion C2 and a slightly tapering cam portion C3. A cross rod 46 is passed (in the following order) through slots 38 and 34, bars 25 and 26, and slots 36 and 40. The rod is free to move within the guide-slots while it is being fixedly held (by friction) by the bars 25, 26. Finally, a leaf-spring 48 is provided urging the member 14 away from the housing 12.

The operation of the device will now be evident in view of the series of positions illustrated in FIGS. 2–5. Thus, it will be noted that in the initial relative position of the guide-slots, as governed and controlled by the two free ends of the cross rod 46, the stamp plate 22 is kept a small distance apart from the ink pad 18. As stated above, this will assure prolonged useful life of the ink pad sponge material.

Upon the initial downward movement of the member 14 (Figs. 3*a*–3*b*), the stamp plate will advance to the left against the ink pad and become wetted. This progressive sidewise movement of the plate is effected by the cam portion(s) C1 of the slots 38, 40, and enabled by the upper left-hand side(s) of the slots 34 and 36 (only partly shown in the Figures).

Figure 3A:
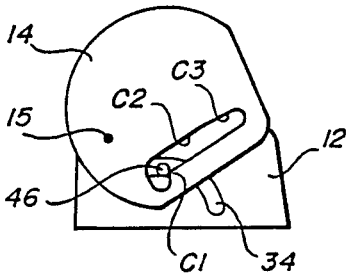
FIGS. 3*a* and 3*b* are, respectively, a side view and a sectional view of the device in a first operational position.
Figure 3B:
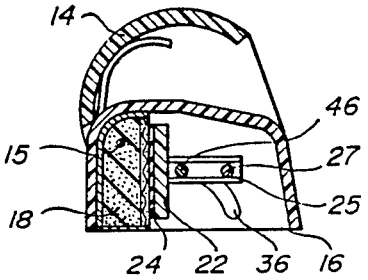
Figure 4A:
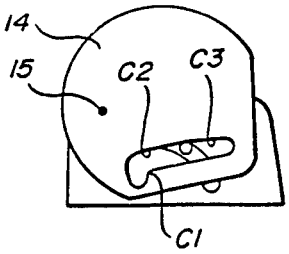
FIGS. 4*a* and 4*b* are, respectively, a side view and a sectional view of the device in a second operational position.
Figure 4B:
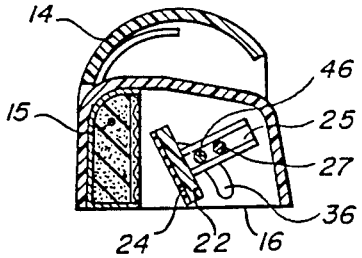
Figure 5A:
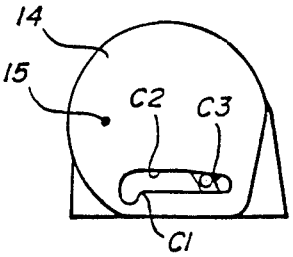
FIGS. 5*a* and 5*b* are, respectively, a side view and a sectional view of the device in a final operational position.
Figure 5B:
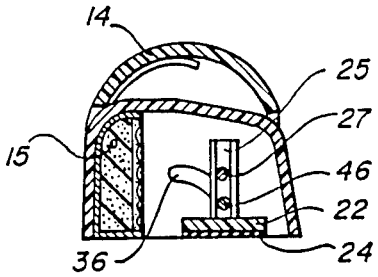

Further movement of the member 14 causes retraction of the plate from the contact position of FIG. 3*b* together with a counterclockwise rotation as shown in FIG. 4*b*. This movement is a result of the combined guidance of the cam portions C2 and the complementary downward-sloping portions of the slots 34 and 36.

Completion of the manipulable member movement effects the actual stamping when the rubber stamp is brought face-down and pressed against the surface, where the free ends of the cross rod 46 slide along the cam portions C3. The lower the movement of the member 14, the harder the pressure which is applied on the stamped surface.

Figure 6:
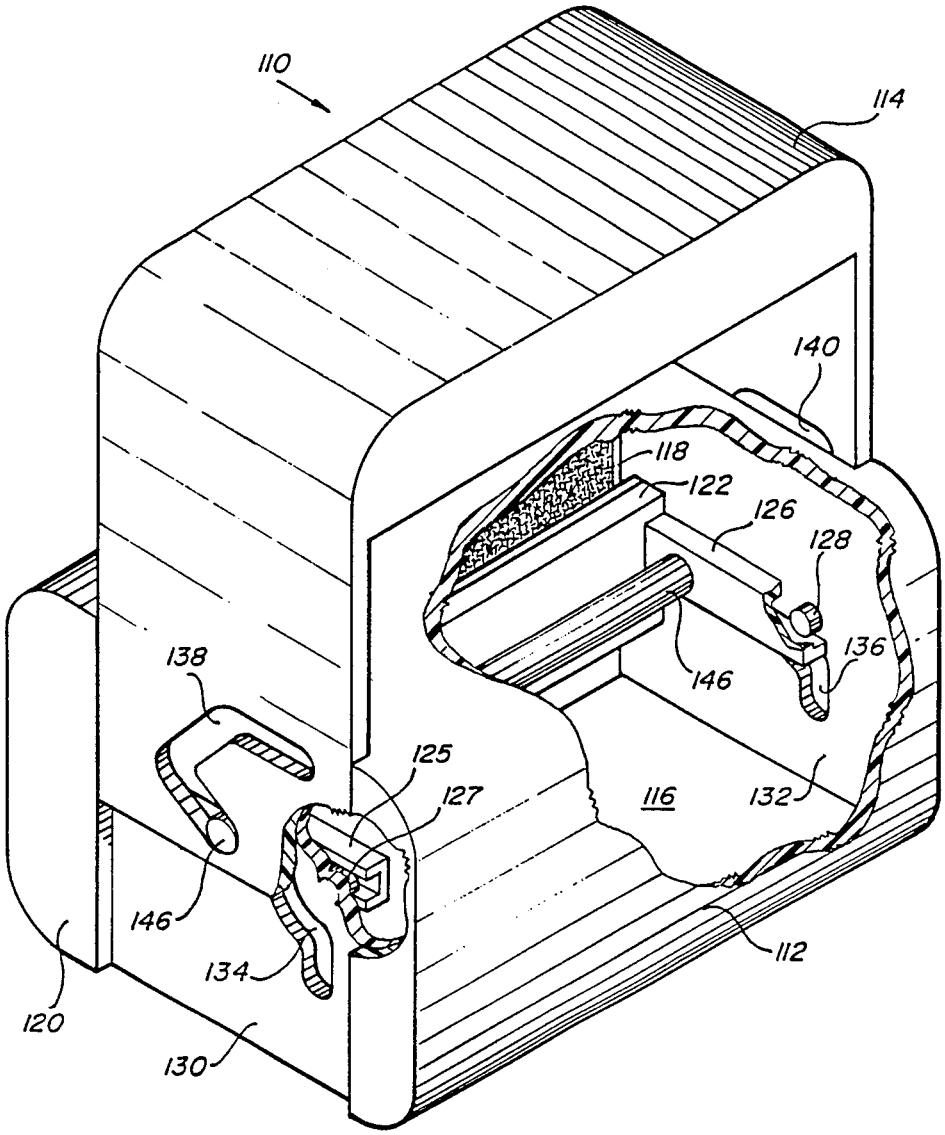
FIG. 6 is a general, three-dimensional view of a second embodiment of the invention.

The device according to the modified version of FIG. 6 is constructed and operates in a directly analogous manner. Hence, similar reference numerals will be used in the following description thereof.

Figure 7A:
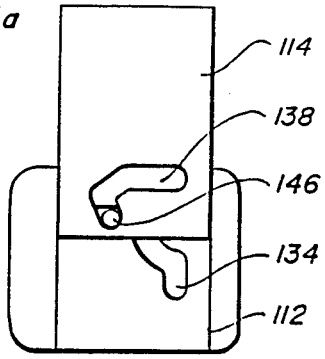
FIGS. 7*a* and 7*b* are, respectively, a side view and a sectional view of the device of FIG. 6 in its inoperative position.
Figure 7B:
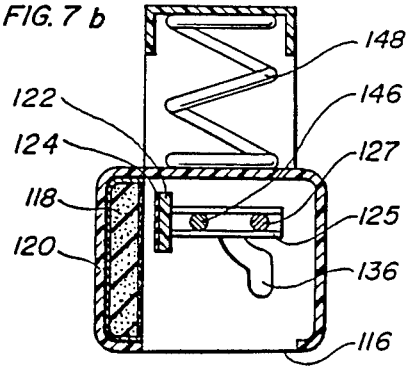
Figure 8A:
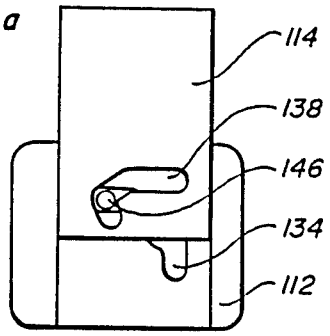
FIGS. 8*a* and 8*b* are, respectively, a side view and a sectional view of the device in a first operational position.
Figure 8B:
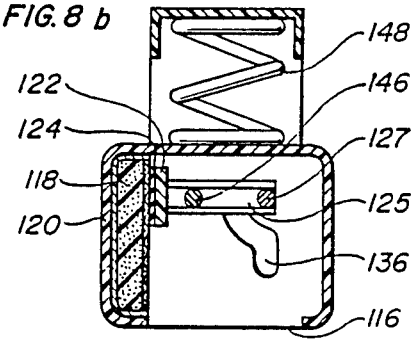
Figure 9A:
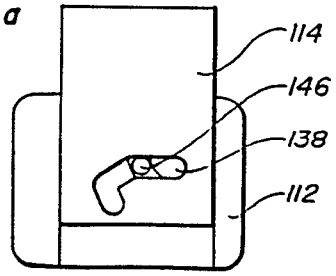
FIGS. 9*a* and 9*b* are, respectively, a side view and a sectional view of the device in a second operational position.
Figure 9B:
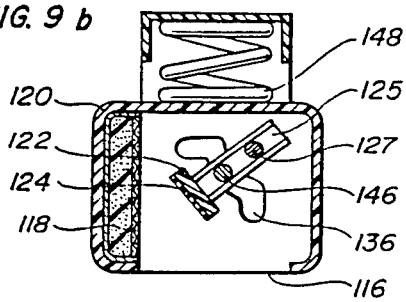
Figure 10A:
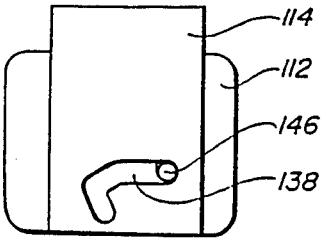
FIGS. 10*a* and 10*b* are, respectively, a side view and a sectional view of the device in the final operational position.
Figure 10B:
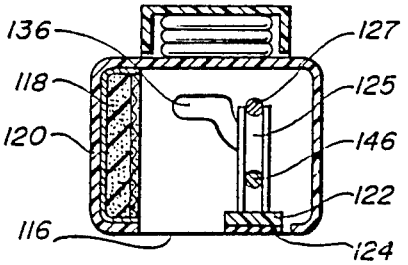

In FIG. 6, the device 110 comprises a stationary housing member 112 and a manipulable member 114. Back wall 120 of the housing 112 is formed as a receptacle for the rubber sponge ink pad 118 (see FIG. 7*b*).

Movement of the member 114 against the housing 112 is, in this case, linear, and suitable guide means are provided (not shown) for reciprocal sliding movement against one or two coil springs 148.

As in the preceding embodiment, rubber stamp plate 122 is provided in a vertical position facing the ink pad 118. The plate 122 is rotatably as well as displaceably mounted within the housing 112 by the same guide-slots arrangement, as shown, and need not be described again. Cross bar 146 extends through guide-slots 134, 136 of the housing side walls 130, 132, and slots 138, 140 in the respective side walls of the member 114, the arrangement being such that by pressing the member 114 downwards, the stamp plate performs 10 the series of movements illustrated in FIGS. 8*b*–10*b*. The curvatures of the slots are merely a result of design considerations.

Again, the guide-slots are configured so as to keep the stamp plate away from the ink pad at the initial, inoperative position, bring the rubber stamp 124 into momentary contact with the ink pad, and proceed downwards by a 90-degree rotation in a counterclockwise direction. In light of the foregoing description, it will be readily appreciated that the device according to the invention presents outstanding and unique advantages over conventional automatic rubber stamps. It is comprised of only a small number of parts, and compactly arranged, resulting in a conveniently operable, pocket-size article.

It is further submitted that it is mainly the overall design features of the device, as afore-described, which enable the maintenance of the rubber stamp away from the ink pad during non-use of the device, in such a simple and straightforward manner.

Those skilled in the art to which the invention pertains will readily understand that many changes, modifications and variations may readily be applied to the above-described embodiments without departing from the scope of the invention as defined in and by the appended claims.

What is claimed is:

1. In a self-inking rubber stamping device comprising a housing having opposite side walls and an open bottom adapted to be placed over a surface to be stamped;

an ink pad fixedly mounted within the housing;

a manipulable member having a top wall and opposite side walls, the member being coupled to and moveable with respect to the housing;

a pivotable and displaceable stamp plate; and an overturning mechanism for effecting the pivotal displacement of the stamp plate by the manipulable member between an inoperative position, wherein the stamp plate is withdrawn into the housing and the stamp plate faces the ink pad, and an operative position, wherein the stamp plate is pivoted and displaced to become pressed against the surface to be stamped through the bottom of the housing, the improvement which comprises:

the ink pad is mounted in an upright position and has a lower side that is substantially flush with the bottom of the housing;

in the inoperative position, the stamp plate is maintained at a predetermined distance away from the ink pad;

a plurality of first guide slots supporting the stamp plate for allowing a combined linear and rotational movement of the stamp plate;

first axles fixed to the housing and coupled to the first guide slots for enabling the combined movement of the stamp plate with respect to the first axles;

a second axle fixed to the stamp plate for causing the combined movement of the stamp plate as the second axle is moved; the second axle having two projecting ends;

second guide slots formed in opposite side walls of the housing through which the projecting ends of the second axle pass;

third guide slots formed in the opposite side walls of the manipulable member through which the projecting ends of the second axle also pass;

the second and third guide slots being shaped differently from one another but overlapping each other for cooperating to move the second axle along both the second and the third slots simultaneously and also for defining only one location along each of the second and third slots for each position of the manipulable member with respect to the housing and the second and third guide slots also being so shaped that by operating the manipulable member toward the operative position the second axle is moved such that the stamp plate is initially moved laterally toward and into a contact with the ink pad, and then laterally away from the ink pad and then is also rotated into the face-down surface-pressing position.

2. The device as claimed in claim 1, wherein the stamp plate has a pair of rearwardly extending U-shaped bars, and each side wall of the housing is provided with a projection in axial alignment with the bars and forming the first axles, each projection supporting one of the bars during the combined movement of the plate.

3. The device as claimed in claim 2, wherein the second axle passes through and is frictionally held by the bar at its side adjacent the plate.

4. The device as claimed in claim 1, wherein the manipulable member is hinged to the housing and is spring-biased into the inoperative position.

5. The device as claimed in claim 1, wherein the manipulable member is slidingly mounted on the housing and is spring-biased into the inoperative position.

6. The device as claimed in claim 1, wherein the second slots curve downwardly toward the bottom of the housing while the third slots have differently curved portions, with a first curved portion curved for moving the second axle up along the second slots to move the stamp plate toward the ink pad when the second axle are up to hold the stamp plate upright and with another curved portion for moving the second axle down along the second slots to rotate the stamp plate down.

* * * * *